US008572991B2

(12) United States Patent
Arensmeier

(10) Patent No.: US 8,572,991 B2
(45) Date of Patent: Nov. 5, 2013

(54) CONDENSATE LIQUID LEVEL SENSOR AND DRAIN FITTING

(75) Inventor: Jeffrey N. Arensmeier, Fenton, MO (US)

(73) Assignee: Emerson Electric Co., St. Louis, MO (US)

( * ) Notice: Subject to any disclaimer, the term of this patent is extended or adjusted under 35 U.S.C. 154(b) by 301 days.

(21) Appl. No.: 13/162,798

(22) Filed: Jun. 17, 2011

(65) Prior Publication Data

US 2012/0318381 A1 Dec. 20, 2012

(51) Int. Cl.

| | |
|---|---|
| ***F24F 13/22*** | (2006.01) |
| ***G01F 23/22*** | (2006.01) |
| ***G01F 23/24*** | (2006.01) |

(52) U.S. Cl.

USPC ..... 62/129; 62/285; 73/295; 73/304 R; 340/620; 340/622

(58) Field of Classification Search

USPC ..... 137/558, 104; 73/295; 62/129, 285; 340/622, 620

See application file for complete search history.

(56) References Cited

U.S. PATENT DOCUMENTS

| | | | | |
|---|---|---|---|---|
| 4,261,382 A | | 4/1981 | Bridges | 137/187 |
| 5,522,229 A | | 6/1996 | Stuchlik, III et al. | 62/127 |
| 5,755,105 A | * | 5/1998 | Lacoste | 62/129 |
| 5,854,518 A | * | 12/1998 | Revis | 307/118 |
| 6,976,367 B2 | | 12/2005 | Spanger | 62/129 |
| 7,523,661 B2 | * | 4/2009 | Dwyer et al. | 73/295 |
| 7,821,411 B1 | * | 10/2010 | Ward | 340/616 |
| 2011/0019984 A1 | | 1/2011 | Glover | 392/465 |

OTHER PUBLICATIONS

"New Open Circuit Electronic Condensate Sensors", Resource Conservation Technologies;http://www.rctus.com/index.php?option=com_content&view=article&id=303&Itemid=311&lang=en; © 2009 Resource Conservation Technologies, Inc.; 1 page.

* cited by examiner

*Primary Examiner* — John Rivell

(74) *Attorney, Agent, or Firm* — Harness, Dickey & Pierce, P.L.C.

(57) ABSTRACT

A fluid level sensor and drain fitting is provided that includes a fitting body having a first annular end, a second external-threaded end with an opening therein, and a passage extending from the opening to the first annular end. The drain fitting further includes a plurality of sensors forming an array on the second external-threaded end radially spaced around the opening such that at least one sensor is above the centerline of the opening regardless of the rotational position of the fitting. Each of the sensors are configured to provide an output that changes in response to contact with water. The plurality of sensors are configured to detect a water level relative to the opening in the fitting body based on the number of sensors in the array that provide an output indicative of contact with water.

20 Claims, 5 Drawing Sheets

CONDENSATE LIQUID LEVEL SENSOR AND DRAIN FITTING

FIELD OF THE INVENTION

The present invention relates to controls for controlling residential air conditioning and ventilation systems.

BACKGROUND OF THE INVENTION

Climate control systems are typically utilized to maintain the temperature of a space relative to a set point by activating an air conditioning unit to cool the space. The air conditioning unit supplies sub-cooled refrigerant to an evaporator coil, which cools warm air from the space that is circulated across the evaporator coil. When the warm air contacts the colder surface of the evaporator coil, condensation of water can occur. The water condensation runs down the sides of the evaporator coil and collects in a condensate pan. The condensate pan has a condensate drain fitting and drain line attached thereto, which allows the water to drain from the condensate pan.

However, blockage in the condensate drain line can occur due to algae, fungus or bacterial growth forming particles that create restrictions in the drain line and can cause a clog. This will cause water to back up into the condensate drain pan. When the condensate pan is full of water, the water will overflow out of the pan and into the residential space, and potentially cause water damage to the residence. These flaws in condensate pan designs can also result in problems and/or damage to the air conditioning system.

SUMMARY OF THE INVENTION

This section provides a general summary of the disclosure, and is not a comprehensive disclosure of its full scope or all of its features.

Various embodiments of a condensate fluid level sensor and drain fitting are provided. In one preferred embodiment, a combined fluid level sensor and drain fitting is provided. The fluid level sensor and drain fitting comprises a fitting body having a first annular end, a second external-threaded end with an opening therein, and a passage extending from the opening to the first annular end. The drain fitting further includes an array of sensors disposed on the second external-threaded end radially spaced around the opening such that at least two sensors are above the centerline of the opening. Each of the sensors are configured to provide an output that changes in response to contact with water, wherein the array of sensors are configured to detect a water level relative to the opening in the fitting body based on the number of sensors in the array that provide an output indicative of contact with water. The sensors are configured to detect a water level indicative of a clogged condensate drain when a majority of the sensors provide an output indicative of contact with water.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. According to one aspect of the present disclosure, a combined fluid level sensor and drain fitting is provided. The fluid level sensor and drain fitting comprises a fitting body having a first annular end, a second external-threaded end with an opening therein, and a passage extending from the opening to the first annular end. The fluid level sensor and drain fitting further includes a plurality of sensors disposed on the second external-threaded end radially spaced around the opening such that at least two sensors are above the centerline of the opening. Each of the sensors are configured to provide an output that changes in response to contact with water, wherein the plurality of sensors are configured to detect a water level relative to the opening in the fitting body based on the number of sensors in the array that provide an output indicative of contact with water.

The fluid level sensor and drain fitting are preferably configured to detect a water level indicative of a clogged condensate drain line when a majority of the sensors provide an output indicative of contact with water. The plurality of sensors may be employed in a circuit including the sensors, which is configured to detect when a majority (or all) of the sensors provide an output indicative of water contact. In some embodiments, the fluid level sensor and drain fitting may be employed with a controller, where the controller is in communication with the output of the circuit and/or sensors, and is configured to communicate a signal indicative of a clogged condensate drain line based on the output of the plurality of sensors, as explained below.

Figure 1:
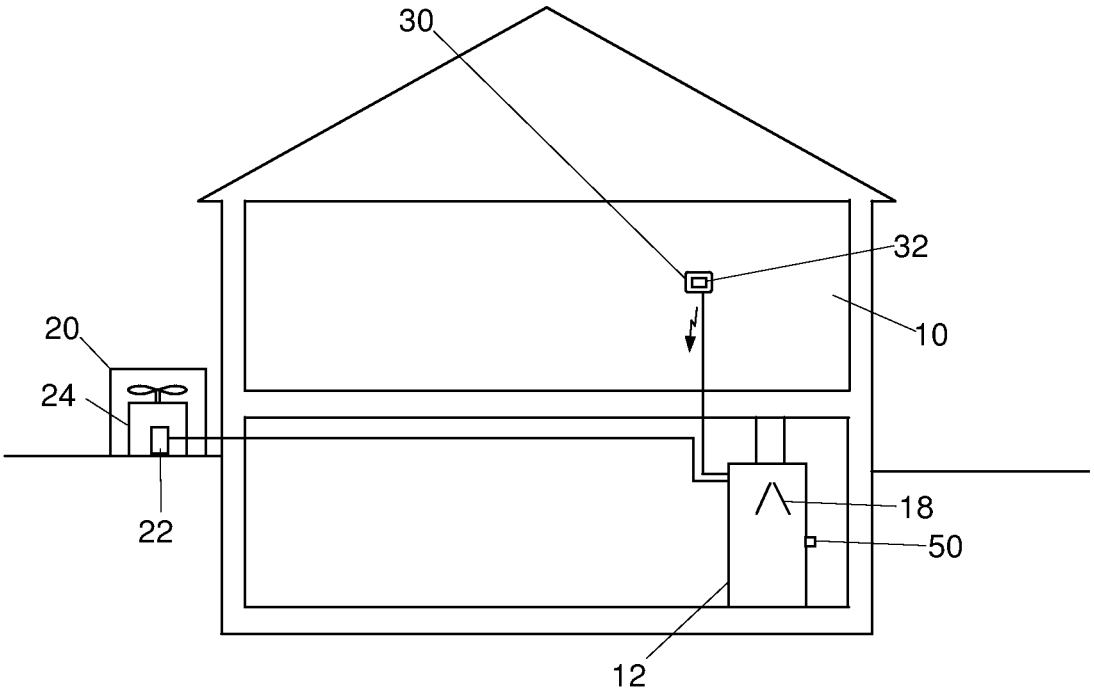
FIG. 1 is an illustration of a space having a climate control system including an air conditioning and/or heat pump system, in which one embodiment of a condensate fluid level sensor may be implemented in accordance with the principles of the present disclosure.

Referring to FIG. 1, a climate control system for conditioning a space 10 is shown. The climate control system preferably includes an indoor air circulation unit 12 having an evaporator coil 18 and an air conditioner unit 20 having a compressor 22 and condenser coil 24 for providing cooling operation. The climate control system may be controllably operated by a thermostat 30 for the space 10. Warm air from the space 10 is circulated across the evaporator coil 18, in which a sub-cooled refrigerant removes heat from the air. When the warm air contacts the colder surface of the evaporator coil 18, condensation of water can occur. The water condensation is collected and drained through a fluid level sensor and drain fitting 50, as explained below.

Figure 2:
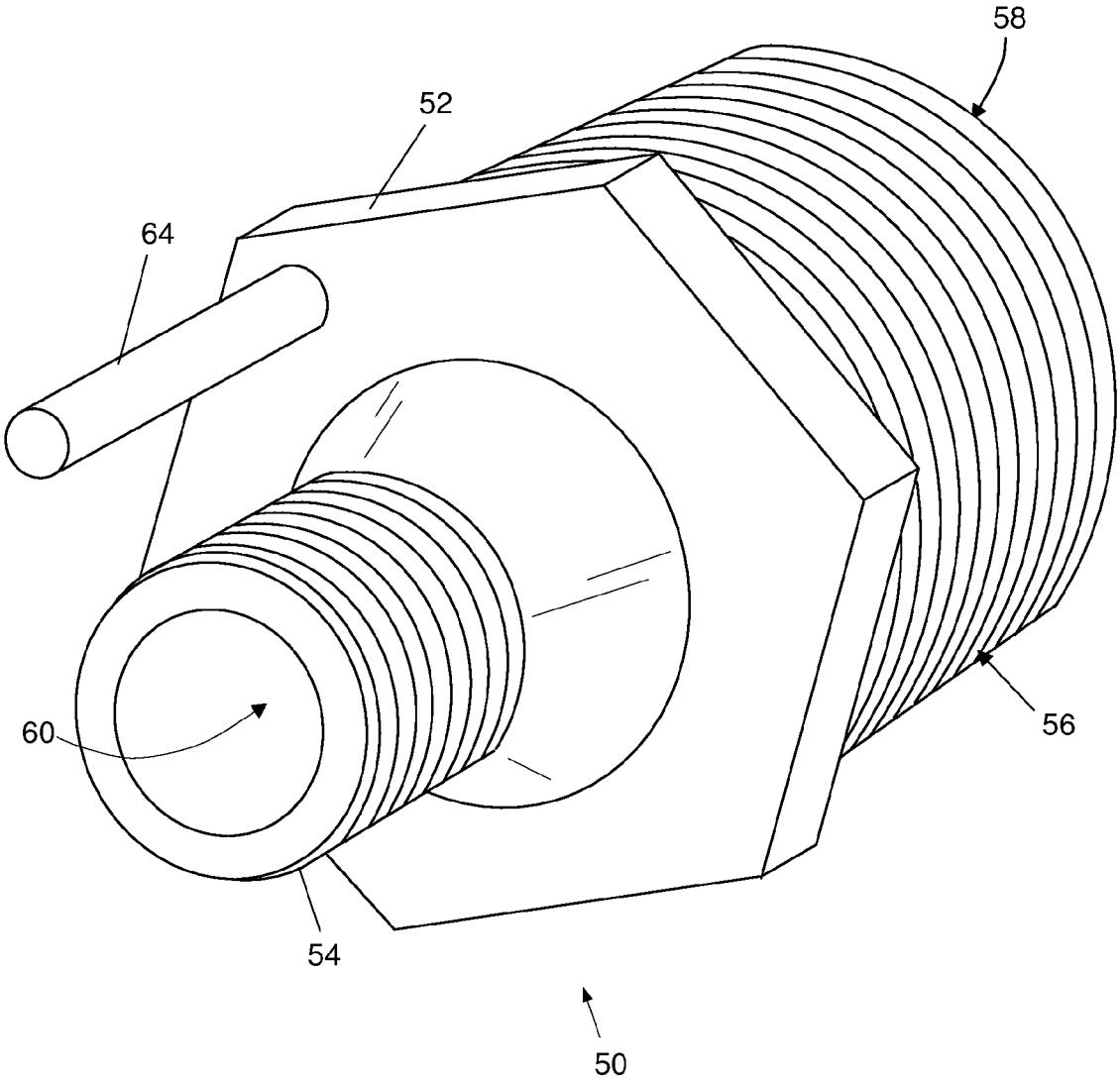
FIG. 2 is a front perspective view of one embodiment of a condensate fluid level sensor and drain fitting, in accordance with the present disclosure.

According to one aspect of the present disclosure, a fluid level sensor and drain fitting 50 for a condensate pan is provided as shown in FIG. 2. The fluid level sensor and drain fitting 50 enables draining of condensate water and detection of a clog in a condensate drain line. As shown in FIG. 2, the drain fitting 50 comprises a fitting body 52 having a first annular end 54, a second externally-threaded end 56 with an opening 58 therein, and a passage 60 extending from the opening 58 to the first annular end 54. The first annular end 54 may include a plurality of barbs (or alternatively threads) as shown in FIG. 2, for engaging the inside of a drain tube. The first annular end 54 may also be a pvc-type connection to be glued/secured inside a drain tube. The second external-threaded end 56 is configured to be installed and secured within an opening in a condensate pan (see FIG. 4). The fitting body 52 may further include a hex-shaped portion as shown in FIG. 2, for enabling connection of a wrench thereto, to aid in installation of the sensor and drain fitting 50.

Figure 3:
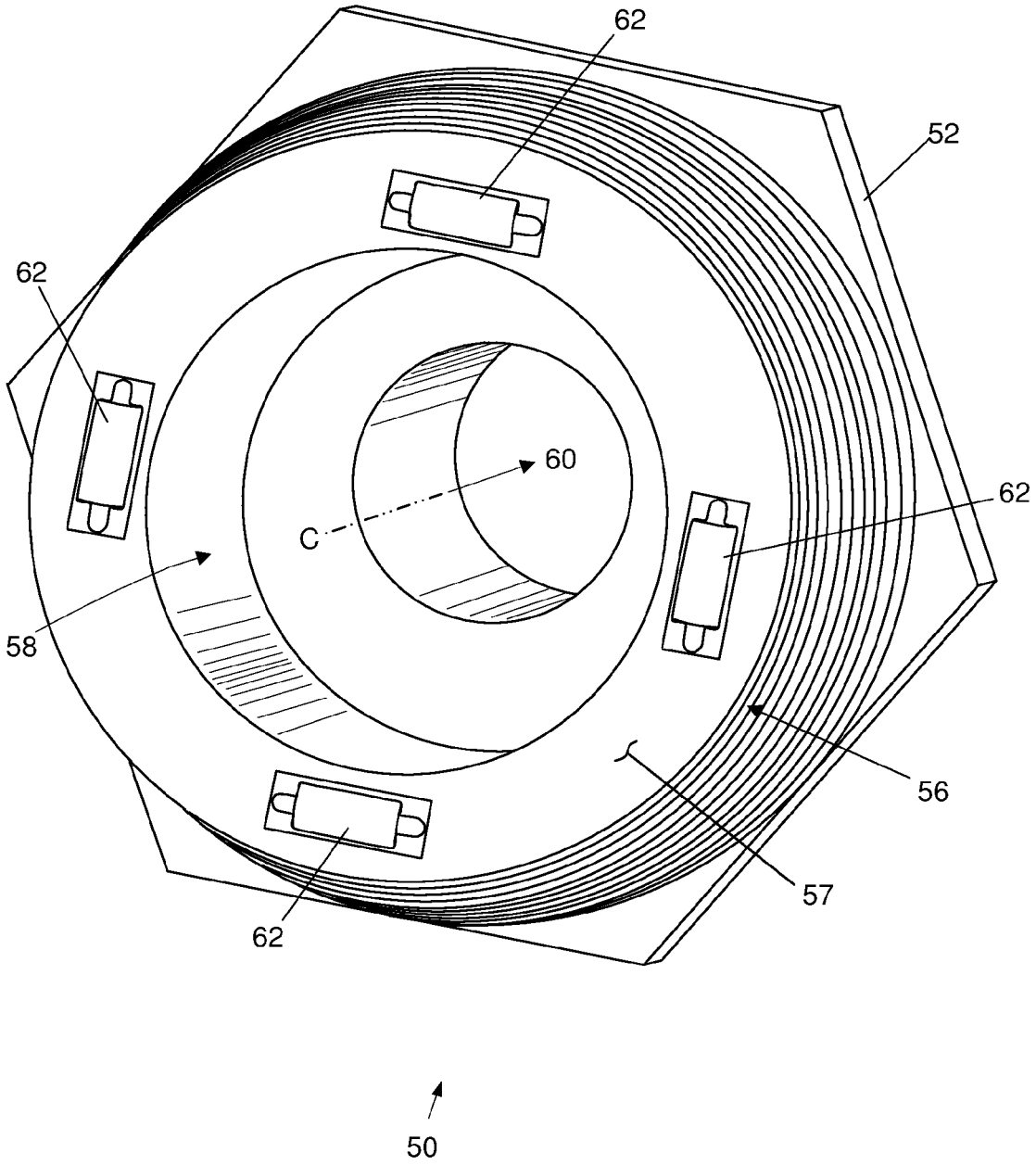
FIG. 3 is a rear perspective view of the condensate fluid level sensor and drain fitting in FIG. 2.

Referring to FIG. 3, the drain fitting 50 further includes a plurality of sensors 62 arranged in an array on a surface 57 of the second external-threaded end 56, being radially spaced around the opening 58 such that at least one sensor 62 is above the centerline C of the opening 58 regardless of the rotational position of the fitting. For example, where at least four sensors 62 are arranged in an array, the fitting 50 may be positioned such that two sensors 62 are above the centerline of the opening 58. Each of the sensors 62 are configured to provide an output that changes in response to contact with water, wherein the array of sensors 62 are configured to detect a water level relative to the opening 58 in the fitting body 52 based on the number of sensors 62 in the array that provide an output indicative of contact with water. The condensate fluid level sensor and drain fitting 50 are configured to detect a water level indicative of a plugged condensate drain line, based on the number of sensors 62 in the array that provide an output indicative of contact with water, as explained below.

The sensors 62 are preferably configured to provide an output that changes in response to contact with or proximity to water. The sensors 62 may employ optics, a tuning fork, or conductivity to sense the presence of water. For example, the sensors 62 may be configured to employ conduction to sense water, where the resistance or associated output of the sensor 62 changes in response to contact with water. The embodiment in FIG. 4 preferably employs thermal based sensors 62 that comprise thermistors, the resistance of which changes in response to conduction of heat to water that is proximate to or contacting the sensor 62. The sensors 62 may also be self-heating thermistors, or optionally heated by a separate resistor. The sensors 62 may be over-molded within the fitting body 52 or potted in place. The plurality of sensors 62 are preferably electrically connected, via one or more wires 64 enclosed within the fitting body 52, to form part of an electrical circuit. Accordingly, the sensors 62 may be included in a circuit for providing an output indicative of the presence of water proximate the sensor 62.

Figure 4:
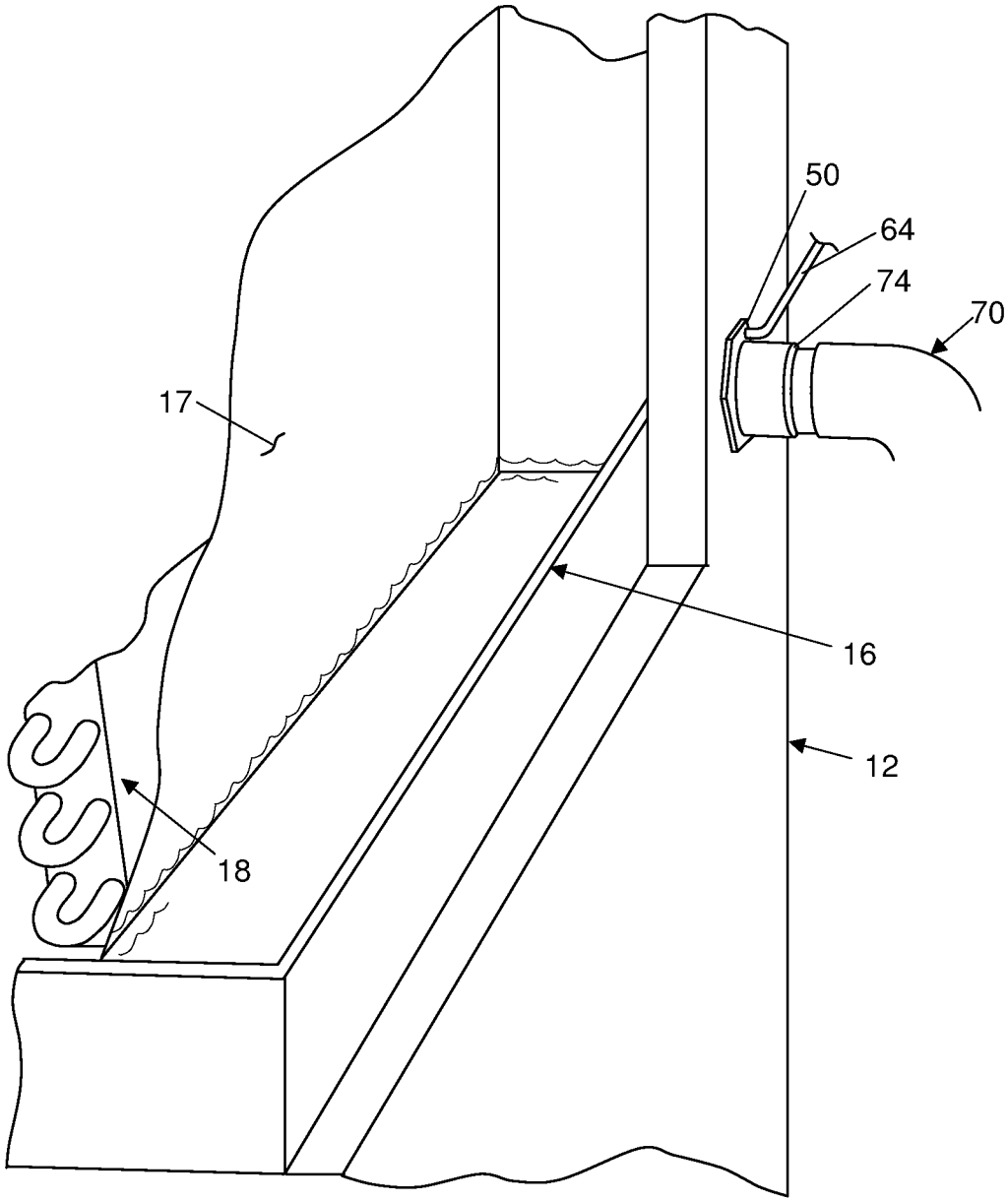
FIG. 4 is a perspective view of a portion of an evaporator coil and condensate pan of an air handling unit, shown with the condensate fluid level sensor and drain fitting installed.

Referring to FIG. 4, a perspective view is shown of a portion of an enclosed evaporator coil 18 in an air circulation unit 12 having a condensate pan 16 and a condensate fluid level sensor and drain fitting 50 installed therein. The sensor and drain fitting 50 is preferably installed (via the external-threaded end 56 shown in FIGS. 2-3) within an opening in the side of the condensate pan 16, and may be disposed in close proximity to the evaporator coil 18 of the indoor air circulation unit 12. A condensate drain tube 70 may be secured (via a connector end 74) to the first annular end 54 of the sensor and drain fitting 50 (as shown in FIG. 2). The combined fluid level sensor and drain fitting 50 is preferably configured to replace a conventional pipe fitting that is typically installed in the opening in the condensate pan. The sensor and drain fitting 50 includes a hollow passage 60 (FIG. 3), such that the drain path provided by the originally installed fitting is duplicated when the combined sensor and drain fitting 50 is installed.

When warm air contacts the colder surface of the evaporator coil 18, condensation of water occurs and collects in the condensate pan 16. If algae or bacterial growth forms a restriction that causes blockage in the condensate drain tube 70, condensate water will back up into the condensate drain pan 16. The resulting increase in water level in the condensate pan 16 can be detected by sensors, as explained below.

Installation of a stand-alone conventional sensor for sensing water in the condensate pan 16 would require removing a panel 17 (FIG. 4) to gain access for accurately positioning a sensor relative to the condensate pan 16 and routing wires around the panel 17. Unlike conventional sensors, the combined fluid level sensor and drain fitting 50 does not require removal of any panel 17, since it is installed within a drain opening in the condensate pan 16. This installation also positions the sensors 62 (FIG. 3) to enable detecting a water level indicative of a clogged drain tube 70 when a majority (or all) of the sensors 62 provide an output indicative of proximity to water.

Figure 5:
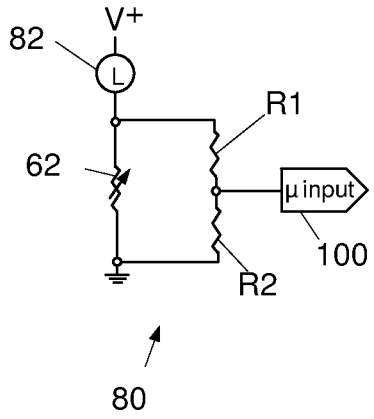
FIG. 5 is a schematic diagram of one embodiment of a circuit connection to the fluid level sensor for detecting a blocked drain line.

Referring to FIG. 5, a schematic diagram is shown of an electrical circuit 80 including a sensor 62 of the fluid level sensor and drain fitting 50 (as shown in FIG. 3). The electrical circuit 80 is configured to provide an output for the sensor 62 that is indicative of the presence of water proximate the sensor 62. The sensor 62 in FIG. 5 is a self-heating thermistor having a nominal resistance of 10 kiloohms that changes in response to water in proximity to or contacting the sensor 62. A voltage or current source 82 provides a 25 milliamp current that is supplied to the sensor 62. Any change in resistance of the sensor 62 results in a change in the voltage across the sensor 62, and the voltage across resistors R1 and R2. R1 and R2 divide the voltage to a value that is appropriate for input to a controller or input pin of a microprocessor 100, as shown in FIG. 5. Multiple instances of the single sensor electrical circuit 80 could be employed to form a circuit for providing one or more sensor outputs to a controller or microprocessor 100. The circuit would include an array of sensors 62, which could detect a water level indicative of a clogged condensate drain when a majority (or all) of the sensors 62 provide an output indicative of water in proximity to the sensors 62.

Figure 6:
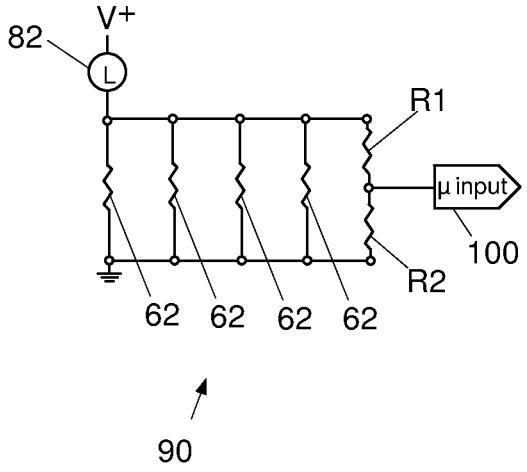
FIG. 6 is a schematic diagram of another embodiment of a circuit connection to the fluid level sensor for detecting a blocked drain line, in accordance with the present disclosure.

Referring to FIG. 6, a schematic diagram is shown of an electrical circuit 90 that includes multiple sensors 62. The electrical circuit 90 is configured to provide an output of a predetermined voltage level that is indicative of a clogged condensate drain 70 when a majority (or all) of the sensors 62 provide an output (e.g., a change in resistance) that is indicative of the presence of water proximate the sensor 62. The sensors 62 may be thermistors having a resistance that changes in response to water in proximity to the sensor 62, where a current source 82 is conducted to the sensors 62. A change in resistance in one sensor 62 will cause a change in voltage that is proportional to the change in total resistance of all the resistors/sensors 62 connected in parallel. Thus, the voltage across the four sensors 62 connected in parallel will not significantly change and reach a limit value until a majority (or all) of the sensors 62 are in contact with or proximity to water. The voltage across the four sensors 62 is also applied across resistors R1 and R2. R1 and R2 divide the voltage to a value that is appropriate for an input pin of a microprocessor 100, as shown in FIG. 6.

Accordingly, the sensors 62 may be included in an electrical circuit that is configured to provide an output indicative of a clogged condensate drain line when a plurality (or all) of the sensors 62 provide an output (e.g., a change in resistance) indicative of the presence of water proximate the sensors 62. The electrical circuit is preferably configured to provide an output indicative of the water level to a controller or microprocessor 100, as explained below.

As shown in FIGS. 5-6, the electrical circuits are each configured to provide an output that may be received by a controller or microprocessor 100. Specifically, the output of the circuit (e.g., electrical circuits 80, 90) may be connected to an input pin of a microprocessor 100 or other comparable controller. In the circuit shown in FIG. 6, the microprocessor 100 is configured to receive the output (e.g. voltage across the sensors 62) and compare it to a reference value that is indicative of a clogged condensate drain line. Alternatively, the microprocessor 100 may be configured to receive the output of each sensor 62 (as shown in FIG. 5), and to determine the level of condensate water based on the number of sensors 62 that provide an output indicative of contact with or proximity to water. In either configuration, the controller or microprocessor 100 is further configured to output the communication of a technician service request upon detecting a water level indicative of a plugged condensate drain line. Such a communication may be received by a thermostat 30 and displayed on the display 32 of the thermostat 30 (FIG. 1). Alternatively, the controller may be part of a Climate Talk enabled HVAC component that is configured to communicate via a Climate Talk CT-485 port to an HVAC control, thermostat 30, or other HVAC device. Such Climate Talk enabled controls and thermostats are manufactured by White-Rodgers, a Division of Emerson Electric Co. When utilized with such devices, the controller can send the communication of a technician service request to one or more Climate Talk enabled devices for alerting a resident or even an HVAC repair service company, to remedy the problem before potential water damage to the residence occurs.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A fluid level sensor and drain fitting, comprising:

a body having a first annular end, a second end having a surface and an opening, and a passage extending through the body between the opening of the second end and the first annular end; and a plurality of sensors disposed at least partially within the surface of the second end of the body, the sensors configured to detect a water level relative to the opening of the body, and each of the sensors being configured to provide an output that changes in response to contact with water.

2. The fluid level sensor and drain fitting of claim 1 wherein the sensors are configured to detect a water level indicative of a plugged condensate drain line based on the number of sensors that provide an output indicative of contact with water.

3. The fluid level sensor and drain fitting of claim 1 wherein each sensor is configured to provide an output that changes in response to thermal conduction with water that is in proximity to or in contact with the sensor.

4. The fluid level sensor and drain fitting of claim 1 wherein each sensor is configured to change in resistance upon contact with water.

5. The fluid level sensor and drain fitting of claim 1 wherein the plurality of sensors are included in an electrical circuit for providing an output indicative of the presence of water proximate to the sensor.

6. The fluid level sensor and drain fitting of claim 5 wherein the electrical circuit is configured to provide an output for each sensor that is indicative of the presence of water proximate the sensor.

7. The fluid level sensor and drain fitting of claim 5 wherein the electrical circuit is configured to provide an output of a predetermined voltage level that is indicative of a clogged condensate drain when a majority of the sensors provide an output indicative of the presence of water proximate the sensor.

8. The fluid level sensor and drain fitting of claim 5 wherein the electrical circuit is configured to provide an output of a predetermined voltage level that is indicative of a clogged condensate drain when all of the sensors provide an output indicative of the presence of water proximate the sensor.

9. The fluid level sensor and drain fitting of claim 5 wherein the electrical circuit is configured to provide an output indicative of the water level to a controller.

10. The fluid level sensor and drain fitting of claim 1 further comprising a controller that is configured to determine the level of condensate water based on the number of sensors that provide an output indicative of contact with water, and that is further configured to output a technician service request upon detecting a water level indicative of a plugged condensate drain line.

11. A drain fitting, comprising:

a body having a first end, a second end, and a passage extending through the fitting between the first end and the second end; and sensors disposed on the second end of the body and spaced radially around an opening defined at the second end of the body by the passage such that at least one of the sensors is positioned generally above a centerline of the opening and at least one of the sensors is positioned generally below the centerline of the opening regardless of a rotational position of the fitting, the sensors configured to detect a water level relative to the body, and each of the sensors being configured to provide an output that changes in response to contact with water.

12. The fitting of claim 11 wherein the sensors are configured to detect a water level indicative of a plugged condensate drain line based on the number of sensors that provide an output indicative of contact with water.

13. The fitting of claim 11 wherein each sensor is configured to provide an output that changes in response to thermal conduction with water that is in proximity to or in contact with the sensor.

14. The fitting of claim 11 wherein each sensor is configured to change in resistance upon contact with water.

15. The fitting of claim 11 wherein the plurality of sensors are included in an electrical circuit for providing an output indicative of the presence of water proximate to the sensor.

16. The fitting of claim 15 wherein the electrical circuit is configured to provide an output for each sensor that is indicative of the presence of water proximate the sensor.

17. The fitting of claim 15 wherein the electrical circuit is configured to provide an output of a predetermined voltage level that is indicative of a clogged condensate drain when a majority of the sensors provide an output indicative of the presence of water proximate the sensor.

18. The fitting of claim 15 wherein the electrical circuit is configured to provide an output of a predetermined voltage level that is indicative of a clogged condensate drain when all of the sensors provide an output indicative of the presence of water proximate the sensor.

19. The fitting of claim 11 further comprising a controller that is configured to determine the level of condensate water based on the number of sensors that provide an output indicative of contact with water, and that is further configured to output a technician service request upon detecting a water level indicative of a plugged condensate drain line.

20. A control system comprising:

a fitting having a first end, a second end having a surface and an opening, and a passage extending through the fitting between the first end and the opening of the second end;

fluid level sensors disposed at least partially within the surface of the second end of the fitting and arranged radially around the opening of the second end of the fitting such that at least one of the sensors is positioned generally above a centerline of the opening and at least one of the sensors is positioned generally below the centerline of the opening regardless of a rotational position of the fitting, the sensors configured to detect a water level relative to the opening of the fitting; and a controller configured to determine the level of water based on the number of sensors that provide an output indicative of contact with water, the controller further configured to output a technician service request upon determining that a water level is indicative of a plugged drain line.

* * * * *